United States Patent [19]

Hall

[11] Patent Number: 4,489,298

[45] Date of Patent: Dec. 18, 1984

[54] INSULATING STRUCTURE FOR MAGNETIC COILS

[75] Inventor: Gary M. Hall, Farmland, Ind.

[73] Assignee: Westinghouse Electric Corp., Pittsburgh, Pa.

[21] Appl. No.: 540,100

[22] Filed: Oct. 7, 1983

Related U.S. Application Data

[63] Continuation of Ser. No. 354,868, Mar. 4, 1982, abandoned.

[51] Int. Cl.[3] ..... H01F 27/32

[52] U.S. Cl. ..... 336/70; 336/206; 336/223; 336/224

[58] Field of Search ..... 336/69, 70, 225, 223, 336/206, 186, 187, 84 C, 224

[56] References Cited

U.S. PATENT DOCUMENTS

| | | | |
|---|---|---|---|
| 2,829,354 | 4/1958 | Sealey | 336/69 |
| 3,333,220 | 7/1967 | Fischer et al. | 336/84 C |
| 3,602,857 | 8/1971 | Robin | 336/70 X |
| 3,602,858 | 8/1971 | Moore et al. | 336/70 X |
| 4,277,534 | 7/1981 | Flowers | 174/110 E X |

FOREIGN PATENT DOCUMENTS

| | | | |
|---|---|---|---|
| 761148 | 8/1952 | Fed. Rep. of Germany | 336/69 |
| 1413549 | 1/1969 | Fed. Rep. of Germany | 336/70 |
| 2246398 | 6/1978 | Fed. Rep. of Germany | 336/70 |
| 1523215 | 5/1968 | France | 336/70 |

*Primary Examiner*—Thomas J. Kozma
*Attorney, Agent, or Firm*—L. P. Johns

[57] ABSTRACT

Electrical inductive apparatus characterized by pancake coils comprised of an outer layer and a plurality of inner layers formed by spirally winding an elongated conductor which conductor has a plurality of strands formed in a row of strands in each layer including an end strand at each end of the row, the end strand being enclosed in dielectric covers with each layer being encased in a dielectric casing, whereby the end strands of adjacent layers are sufficiently insulated to prevent electrical breakdown therebetween.

3 Claims, 6 Drawing Figures

INSULATING STRUCTURE FOR MAGNETIC COILS

This is a continuation of application Ser. No. 06/354,868, filed Mar. 4, 1982, now abandoned.

BACKGROUND OF THE INVENTION

1. Field of the Invention

This invention relates to electrical inductive apparatus, and more particularly it pertains to insulated pancake coils.

2. Description of the Prior Art

Those skilled in transformer art are aware that transformer windings fail when subjected to substantial overvoltage or transient voltages. Under such currents heavy stress conditions concentrate at certain edges of the windings or coils and result in typical breakdown paths.

Where so-called "pancake" coils are involved, a single layer consists of several indentical conductors which are individually insulated in primary paper or tape and the layer of several conductors is then wrapped in secondary paper or tape. The number of secondary papers is dictated by the required impulse turn-to-turn strength. Laboratory tests of turn-to-turn impulse samples indicate that failure normally occurs at the outer ends of the layers between layers and involves only the outside conductor or strand of the layer. Pressboard insulation between the layers increases the withstand voltage, but does not affect the failure mode.

In many transformer environments available space is a factor in determining transformer dimensions, which among other things is dependent upon the coil turn height. Essentially a transformer coil comprises metal conductors and insulation. In present practice a single layer consists of several identical conductors, individually insulated, wrapped overall with the several secondary papers. To reduce the overall height of a coil turn ultimately means reducing either conductor, insulation, or both while maintaining dielectric strength.

SUMMARY OF THE INVENTION

It has been found in accordance with this invention that electrical inductive apparatus may be provided which comprises magnetic core means including a plurality of stacks of superposed metallic laminations arranged to form a magnetic circuit with at least one opening for receiving electrical windings; electrical windings disposed in inductive relation with the magnetic core means extending through said at least one opening and including a plurality of pancake coils; each pancake comprising an outer layer and a plurality of inner layers formed by spirally winding an elongated conductor; the elongated conductor having a plurality of strands forming a row of strands in each layer including an outer strand at each end of a row; the end strand in each row being enclosed in dielectric covers; and each layer being encased in a dielectric casing, whereby the end strands of each layer and more heavily insulated to prevent an electrical breakdown between the corresponding end strands of adjacent layers.

The advantage of the apparatus of this invention is that additional insulation is applied to the outer strands of conductors to maintain the dielectric strength without substantially reducing the cross-sectional area of the conductor per se and without increasing the overall height of the insulated strands.

DESCRIPTION OF THE PREFERRED EMBODIMENT

Electrical inductive apparatus, such as transformers, include electrical windings disposed in inductive relation with a magnetic core. The magnetic core includes at least one opening for receiving electrical windings, and is formed of a plurality of stacks of metallic laminations, such as grain-oriented silicon steel, with the stacks being arranged to form a complete magnetic circuit.

Figure 1:
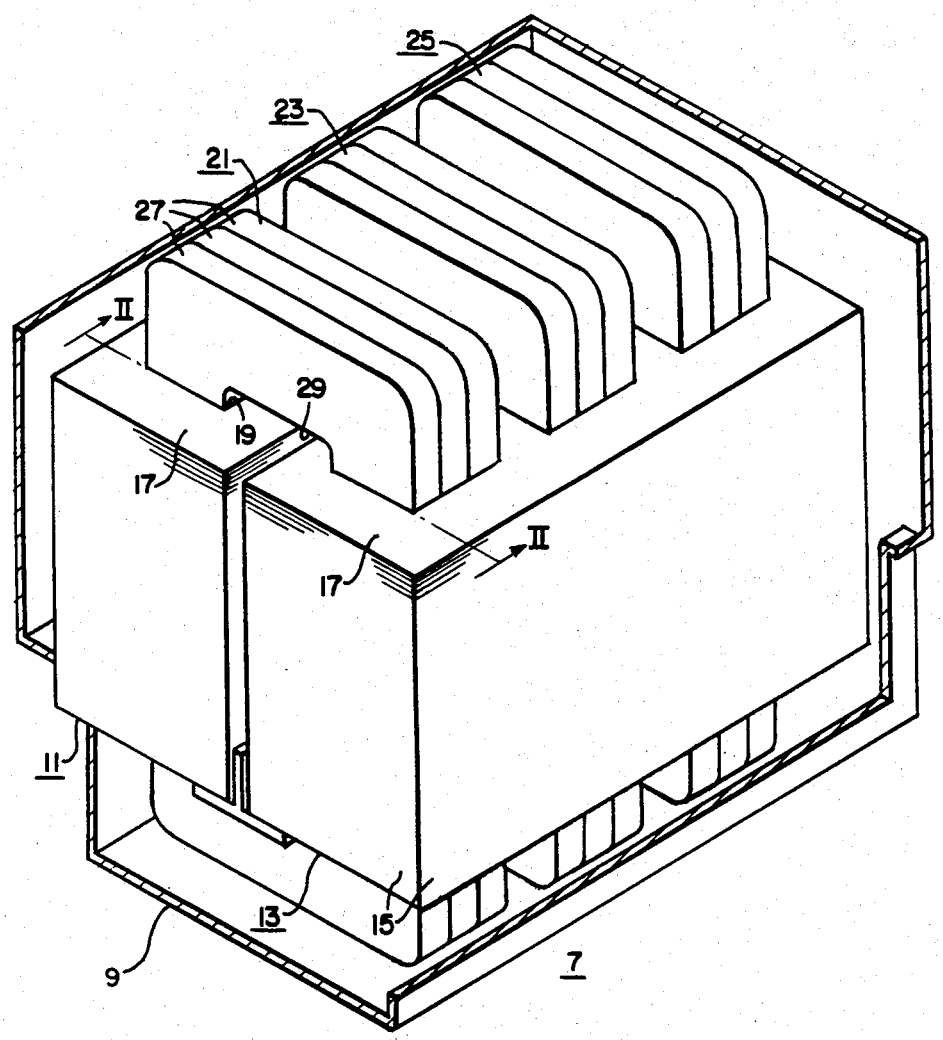
FIG. 1 is a perspective view with portions broken away of a transformer magnetic core-coil assembly.

A transformer of a prior art structure is generally indicated at 7 (FIG. 1) and it comprises a tank 9, magnetic core means including first and second magnetic core sections 11, 13 disposed in side-by-side relation. Each magnetic core section includes a plurality of stacks 15 of superposed metallic laminations 17. The stacks 15 are disposed of openings for receiving electrical windings or coils. The transformer 7 is a three-phase transformer of the shell-form type for illustrative purposes, it being understood that any other form of transformer, such as a single phase, is equally operative for the purpose of this disclosure. Each magnetic core section 11, 13 has three winding openings such as opening 19. The winding openings are perpendicular to the plane of the superposed laminations 17.

Transformer 7 includes three electrical winding phases 21, 23, 25, which include a plurality of pancake coils or windings 27 that are stacked in side-by-side relation with the openings in the coils in alignment, forming openings 29 for receiving the magnetic core sections 11, 13.

Figure 2:
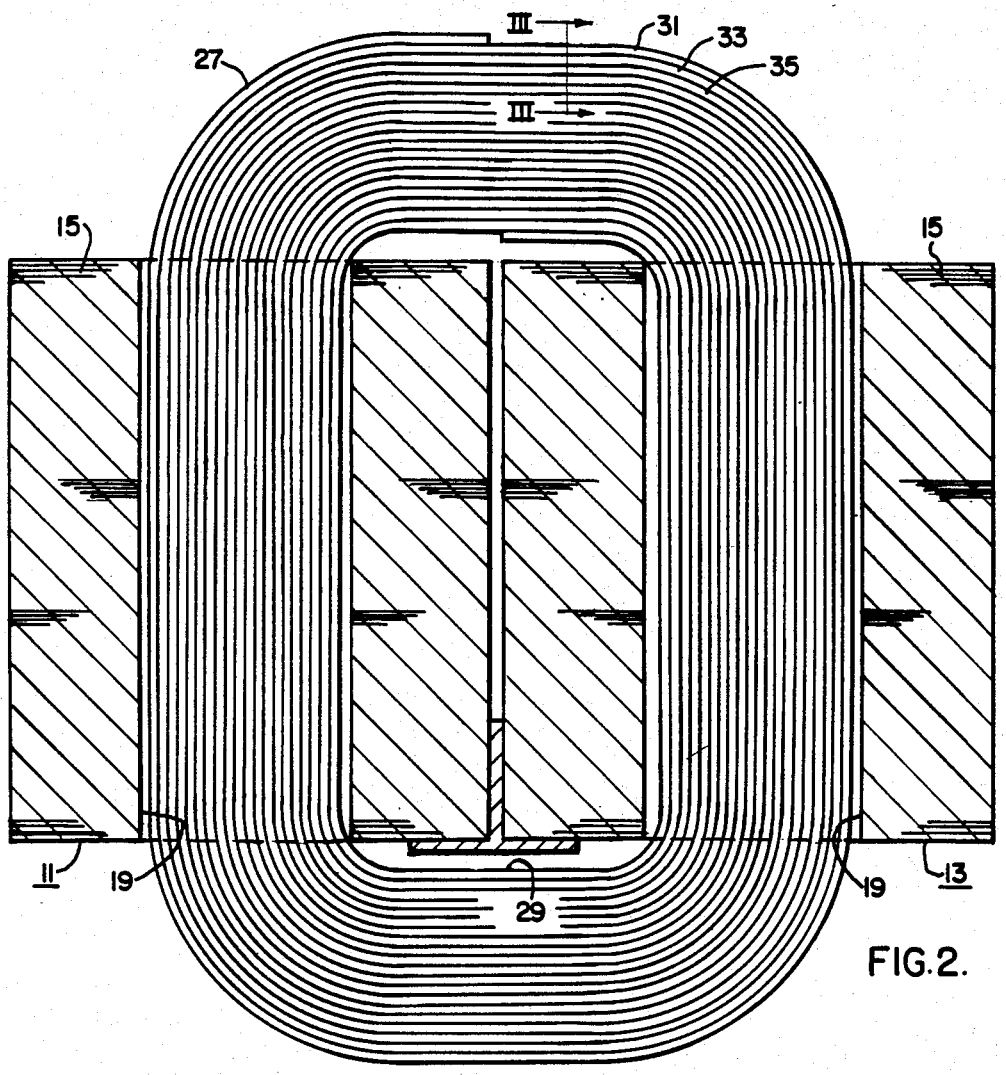
FIG. 2 is a vertical sectional view taken on the line II—II of FIG. 1.

Each coil 27 (FIG. 2) is comprised of an elongated conductor that is wound spirally to form a plurality of layers or turns 31, 33, 35. The elongated conductor has a plurality of strands 37, 39 (FIGS. 3, 4) and inner strands 41 which are comprised of electrical conductive material, such as aluminum or copper. The strands 37, 39, 41 are disposed in a row of strands in each layer or turn 31, 33, so that the several layers or turns 31, 33, 35 are disposed in substantially parallel arrangements.

Figure 3:
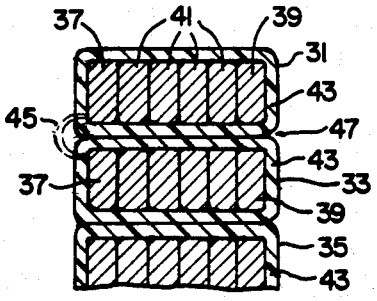
FIG. 3. PRIOR ART
FIG. 3 is an enlarged vertical sectional view of a prior art structure, taken on the line III—III of FIG. 2.

In the prior art structure of FIG. 3, all of the strands in the layer of strands are enclosed within a cover 43 of dielectric material, such as a paper tape, which is wrapped around the assembly of the strands 37, 39, 41 during assembly thereof. Each strand is provided with a separate very thin insulating (unnumber) cover of dielectric material such as enamel. Analysis of turn-to-turn impulse samples show that an electrical failure path 45 normally occurs in the V-shaped oil notch 47 formed between the layers or turns 31, 33 and involves only the outside strands 37, 39 of the layers as a result of stress concentrations along the edges of conductive strands.

Figure 4:
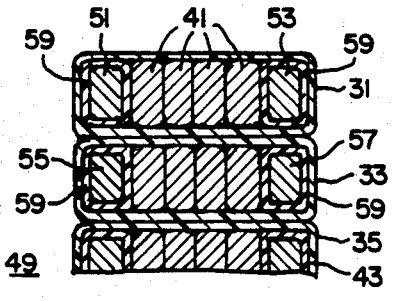
FIG. 4 is a view similar to that of FIG. 3 showing the structure of this invention.

In accordance with this invention, a pancake coil is shown in FIG. 4 in which similar numerals refer to similar parts as those shown in the prior art coil of FIG. 3. The layer or turn 31 includes inner strands 41 as well as outer strands 51, 53 and layer or turn 33 includes similar outer strands 55, 57. Outer strands 51, 53, 55, 57 have smaller width and thickness dimensions than those of inner strands 41, in order to provide for a primary wrap or cover 59 of dielectric material around each outer strands. Thus, the wraps or covers 59 are added to each outer strand 51-57 to insulate the strands to a height equal to that of the inner strands 41. If desirable, the thickness of the outside strands 57 may be increased slightly to maintain the same strand cross-section as the inner strands. To reduce the overall size of the coil 29 compared to that of the prior art coil of FIG. 3, the secondary wrap or cover 43 is reduced by an amount equal to the thickness of the wrap 59. Thus, full insulation thickness is maintained in the area of highest stress while the overall layer height is reduced. This also allows more copper to be added in a given limiting breadth, if desired.

Figure 5:
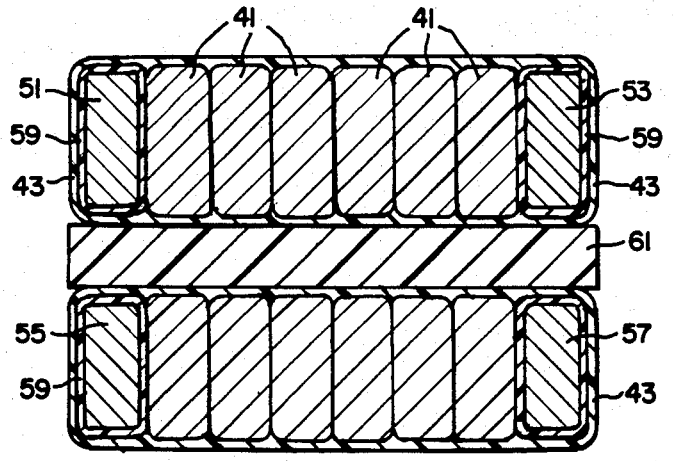
FIG. 5 is a vertical sectional view of another embodiment of the structure.
Figure 6:
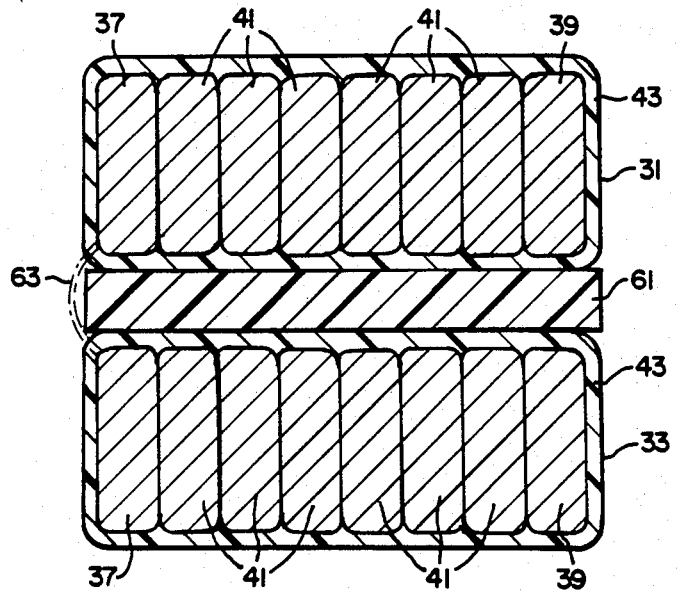
FIG. 6. PRIOR ART
FIG. 6 is a vertical sectional view according to the prior art structure of FIG. 5.

In another embodiment of the invention, as shown in FIG. 5, similar numerals refer to similar parts. The structures of FIGS. 5 and 6 differ from those of FIGS. 3 and 4 in that additional dielectric strip 61 is disposed between each layer or strand 31, 33. The dielectric strip is preferably comprised of pressboard between the turns 31, 33, 35 to increase the withstand voltage, though the failure mode is not affected. Thus, a failure path 63 (FIG. 6) typically exists along the edges of the conductors or other strands 37 where stress concentrates in a manner similar to that of the failure path 45 in the prior art structure of FIG. 3.

In accordance with this invention, outer strands 51, 53, 55, 57 are reduced in height and taped with primary papers 59 to an insulated height equal to that of the inner strands 41 (FIGS. 4 and 5). The thickness of the secondary wrap or cover 43 is then reduced by an amount equal to the paper covers of the outer strands 51-57. This yields a fully insulated layer of reduced height without compromising the desired insulation thickness at the critical areas where stress concentrations develop a form of typical failure paths 63. By reducing the number of secondary wraps or covers 43 (FIGS. 4, 5) from four to two layers 31, 33, 35 are closer together. As a result, there is a reduction in turn heights of each pancake coil 27 without sacrificing dielectric strength.

What is claimed is:

1. Electrical inductive apparatus comprising:

magnetic core means including a plurality of stacks of superposed metallic laminations arranged to form a magnetic circuit about at least one opening for receiving electrical windings;

electrical windings disposed in inductive relation with the magnetic core means, extending through said at least one opening, and including a plurality of pancake coils;

each pancake coil comprising an outer layer and a plurality of inner layers formed by spirally winding an elongated conductor;

the elongated conductor having a plurality of strands forming a row of strands in each layer including an end strand at each end of a row;

the end strands in each row being enclosed in dielectric covers;

each layer being encased in a dielectric casing, whereby the end strands of each layer are more heavily insulated to prevent an electrical breakdown between the corresponding end strands of adjacent layers;

each end strand having reduced width and thickness dimensions by sizes equal to the thickness of the dielectric covers so that the dimensions of the combined end strand and cover equal the corresponding dimensions of the other strands in a given row;

each strand having a rectangular cross-section with a major axis and a minor axis; and all major axes of all strands being parallel and minor axes of all strands being parallel.

2. The apparatus of claim 1 in which the rows are parallel.

3. The apparatus of claim 2 in which dielectric members are disposed between each layer of the pancake coil.

* * * * *